US006763636B2

(12) United States Patent
Dimitrijevic

(10) Patent No.: US 6,763,636 B2
(45) Date of Patent: Jul. 20, 2004

(54) METHOD AND APPARATUS FOR STABILIZING A SUPPORT SYSTEM UTILIZED FOR LIFTING AND LEVELING EXISTING BUILDINGS

(76) Inventor: Mark Dimitrijevic, 3518 Surrey La., Deerpark, TX (US) 77536

( * ) Notice: Subject to any disclaimer, the term of this patent is extended or adjusted under 35 U.S.C. 154(b) by 0 days.

(21) Appl. No.: 09/799,452

(22) Filed: Mar. 6, 2001

(65) Prior Publication Data

US 2002/0124487 A1 Sep. 12, 2002

(51) Int. Cl.[7] ..... E04G 1/22; E02D 27/00; E02D 5/00; E04H 12/00

(52) U.S. Cl. ..... 52/126.1; 52/169.9; 52/300; 405/230

(58) Field of Search ..... 52/126.1, 292, 52/169.9, 741.11, 299, 300, 301; 405/230, 231, 232, 251

(56) References Cited

U.S. PATENT DOCUMENTS

| | | | | |
|---|---|---|---|---|
| 2,141,107 | A | * | 12/1938 | Greulich |
| 2,708,828 | A | * | 5/1955 | Pruyn |
| 3,119,635 | A | * | 1/1964 | Dealy |
| 3,126,709 | A | * | 3/1964 | Dougherty |
| 3,201,834 | A | | 8/1965 | Baittinger |
| 3,282,001 | A | | 11/1966 | Bigalow |
| 3,333,429 | A | * | 8/1967 | Dougherty |
| 3,468,084 | A | | 9/1969 | Vaessen |
| 3,634,985 | A | | 1/1972 | Tipton |
| 3,664,082 | A | | 5/1972 | Zintel |
| 3,677,018 | A | * | 7/1972 | Van Weele |
| 3,796,055 | A | | 3/1974 | Mahony |
| 3,796,056 | A | | 3/1974 | Dougherty |
| 3,973,408 | A | | 8/1976 | Paverman |
| 4,125,975 | A | | 11/1978 | Soble |
| 4,140,427 | A | | 2/1979 | Jackson |
| 4,257,722 | A | | 3/1981 | Nakajima |
| 4,582,167 | A | * | 4/1986 | Contreras ..... 182/182.1 |
| 4,684,097 | A | * | 8/1987 | Cox ..... 248/354.3 |
| 4,721,418 | A | | 1/1988 | Queen |
| 4,854,782 | A | | 8/1989 | May |
| 4,864,785 | A | * | 9/1989 | Schneider ..... 52/167.1 |
| 4,925,345 | A | | 5/1990 | McCown, Jr. et al. |
| 5,246,311 | A | | 9/1993 | West et al. |
| 5,336,021 | A | | 8/1994 | Freeman, III |
| 5,356,241 | A | | 10/1994 | Kunito |
| 5,509,237 | A | | 4/1996 | Coutler |
| 5,575,591 | A | | 11/1996 | Vanderklaauw |
| 5,697,191 | A | * | 12/1997 | MacKarvich ..... 52/146 |
| 5,724,781 | A | | 3/1998 | Matthias et al. |
| 5,951,206 | A | * | 9/1999 | Gregory |
| 6,068,330 | A | * | 5/2000 | Kasuga et al. ..... 296/187.09 |
| 6,193,442 | B1 | | 2/2001 | May |
| 6,247,276 | B1 | * | 6/2001 | Masters et al. ..... 52/169.12 |
| 6,343,449 | B1 | * | 2/2002 | MacKarvich ..... 24/545 |
| 6,379,085 | B1 | | 4/2002 | Vanderklaauw |
| 6,381,907 | B1 | * | 5/2002 | MacKarvich ..... 52/105 |

OTHER PUBLICATIONS

International Search Report for PCT/US02/00954, dated Mar. 6, 2003.

* cited by examiner

*Primary Examiner*—Brian E. Glessner
*Assistant Examiner*—Kevin McDermott
(74) *Attorney, Agent, or Firm*—Thomas, Kayden, Horstemeyer & Risley, LLP

(57) ABSTRACT

An apparatus and a method are provided for lifting and leveling an existing building. At least a first non-cylindrical support section having a substantially rectangular shape and a second support section are coupled together by a fastening device that provides the apparatus with stability once the apparatus has been installed. A jack is used to raise the foundation of the existing building to a desired height. The apparatus is attached to the foundation of the building from underneath the building or from a location adjacent a side of the building. The non-cylindrical support section has low bearing and high friction characteristics. The low bearing characteristics enable the apparatus to be driven further into the earth than cylindrical pilings that are commonly used to lift and level existing buildings. The high friction characteristics assist in maintaining the stability of the apparatus once it has been installed.

11 Claims, 10 Drawing Sheets

METHOD AND APPARATUS FOR STABILIZING A SUPPORT SYSTEM UTILIZED FOR LIFTING AND LEVELING EXISTING BUILDINGS

CROSS-REFERENCE TO RELATED APPLICATION

This application claims priority to the copending U.S. provisional patent application entitled, "Lifting, Leveling And Stabilizing Of Existing Structures System," having Ser. No. 60/252,814, and filed Nov. 22, 2000, which is entirely incorporated herein by reference.

TECHNICAL FIELD OF THE INVENTION

The present invention relates to lifting and leveling (i.e., repairing) existing buildings that have settled unevenly or, for some other reason, have become unstable and need to be re-leveled and stabilized. More particularly, the present invention relates to a method and apparatus for repairing existing buildings by utilizing a support system that comprises an apparatus having non-cylindrical support sections that are coupled together for stability. The non-cylindrical support sections are strong and have relatively low bearing characteristics and relatively high friction characteristics.

BACKGROUND OF THE INVENTION

Several methods and systems have been developed and used for lifting, leveling and stabilizing existing buildings. One common technique used for re-leveling and stabilizing buildings and houses is accomplished by digging a hole underneath a building foundation to a depth generally equal to the length of a cylindrical cement support piling (e.g., 12 inches), driving the cylindrical cement support pilings into the ground one on top of the other until a particular depth has been reached, and jacking a portion of the building up to a particular height by utilizing a jack that is located on the top surface of the uppermost piling.

The pilings are typically driven into the ground until a rock strata is encountered or until the depth of the hole containing the pilings is believed to be sufficiently deep. In situations where a rock strata cannot be reached, the pilings are typically driven to a depth great enough to cause friction between the earth and the outer surfaces of the pilings to prevent substantial movement of the pilings.

One of the problems associated with using this approach is that the cement pilings must have relatively large diameters to provide them with sufficient strength to be driven into the ground to a particular depth and to support the building. The larger the diameter of the cement piling, the more bearing it has, which makes it more difficult to drive the piling into the ground. Another problem associated with using cement pilings is that they often shatter when rock strata and/or tree roots are encountered. For all of these reasons, this type of support system is undesirable.

Another common technique for re-leveling and stabilizing buildings utilizes steel cylindrical pipe sections that are driven into the earth adjacent the side of the building until a sufficient depth is reached. The building foundation is then jacked up using a hydraulic jack to a desired height, and then the foundation is bracketed to the uppermost steel pipe section. The jack is then removed and the building is supported and stabilized by the support system. One of the benefits of using hollow steel pipe sections for this purpose is that they have less bearing than the aforementioned concrete pilings due to the fact that the steel pipe support sections are smaller in diameter than the concrete pilings. Also, steel pipe used for this purpose is normally stronger than concrete and therefore is unlikely to break when rock or tree roots are encountered. However, the steel pipe support sections may bend, which results in instability in the support structure.

One of the disadvantages of using hollow steel pipes for this purpose is that the smaller diameter results in overall less friction between the earth and the surfaces of the steel pipe sections. Also, steel pipes, even if they are galvanized, tend to rust due to water collecting within the pipes after the system has been installed.

SUMMARY OF THE INVENTION

Accordingly, it would be desirable to provide a method and an apparatus for lifting and leveling existing buildings that overcome the aforementioned problems associated with existing support systems. The present invention provides a method and an apparatus for lifting and leveling existing buildings by utilizing a support system that lifts and levels an existing building from underneath the building utilizing non-cylindrical support sections. The apparatus of the present invention comprises at least two support sections, at least one of which is a non-cylindrical support section that is substantially rectangular in shape, which provides the support structure with low bearing and relatively high-friction characteristics. The non-cylindrical support section is, in accordance with the method of the present invention, driven into the earth at a position that is either underneath or adjacent a side of the existing building. The support sections are coupled together by a fastening device so that once the apparatus has been installed, the building is lifted and leveled at an elevated level. The fastening device used to couple support sections together provides great stability and reduces or prevents the possibility that the apparatus will shift and cause the building to become unleveled.

These and other features and advantages of the present invention will become apparent from the following description drawings and claims.

DETAILED DESCRIPTION OF THE INVENTION

Figure 1A:
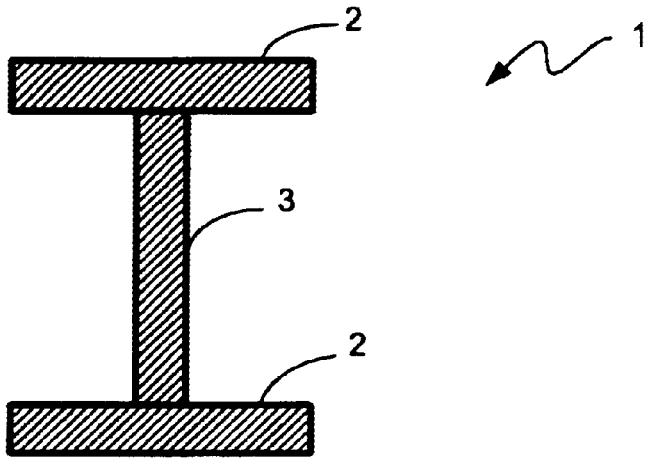
FIG. 1A is an end view of an H-beam that maybe used to lift and level existing buildings in accordance with the method of the present invention.
Figure 1B:
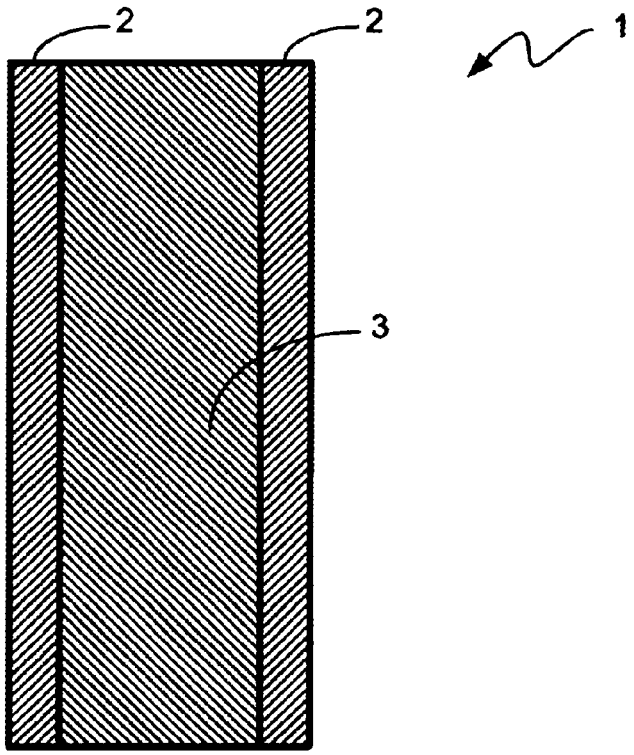
FIG. 1B is a side view of the H-beam shown in FIG. 1A.

As stated above, the present invention is directed to a method and an apparatus for lifting and leveling (i.e., repairing) existing structures, such as buildings and houses (hereinafter referred to collectively as "buildings"). The apparatus of the present invention in accordance with one embodiment comprises one or more H-beams 1, such as the H-beam shown in FIGS. 1A and 1B. FIG. 1A is a top (or bottom) view of an H-beam 1 of the type typically used in constructing large commercial buildings. FIG. 1B is a front view (or rear view) of the H-beam 1 shown in FIG. 1A. In accordance with the present invention, it has been determined the a beam having a non-cylindrical cross-section, such as a cross-section of the type shown in FIGS. 1A and 1B, for example, has decreased bearing characteristics, meaning that it can be driven into the ground easier and deeper than the concrete and steel piling sections that are currently used for lifting and leveling existing buildings.

The H-beam 1 shown in FIGS. 1A and 1B has decreased bearing characteristics due to the fact the area of the end (end view shown in FIG. 1A) of the beam 1 that is driven into the ground is less than that typically used for cement and hollow, steel pipe pilings. However, the outside area surface of the H-beam 1 (shown in FIG. 1B) is large enough to create friction between the earth and the beam 1 to help maintain the beam 1 in place once it has been installed. Therefore, the apparatus of the present invention has very desirable bearing and friction characteristics. Furthermore, the apparatus of the present invention is much stronger than steel pipes and cement pilings, and therefore has much greater stability than support apparatuses or systems comprised of steel pipes or cement pilings.

Figure 2A:
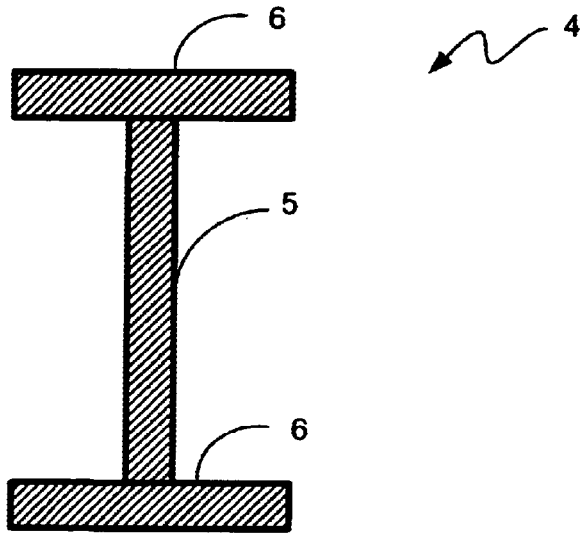
FIG. 2A is an end view of an I-beam that may be used to lift and level existing buildings in accordance with the method of the present invention.
Figure 2B:
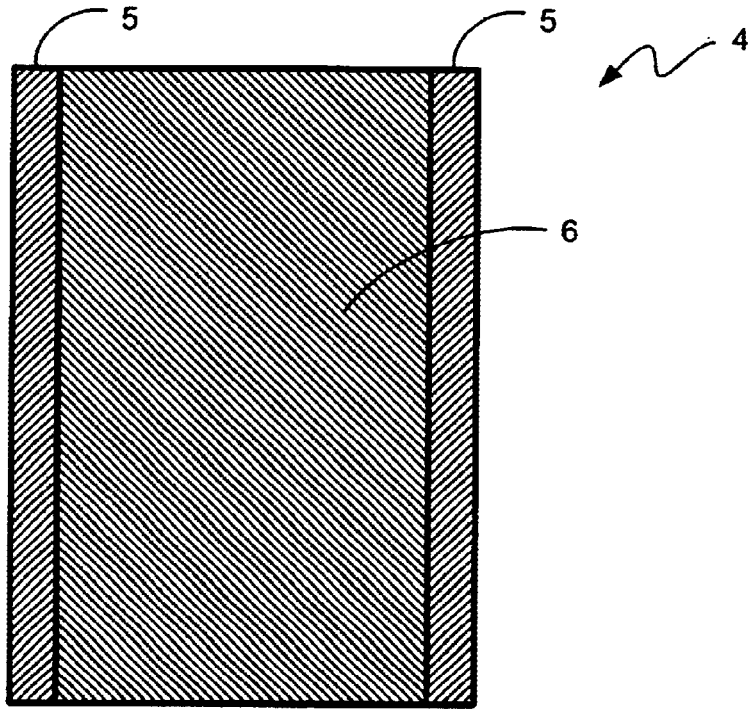
FIG. 2B is a side view of the I-beam shown in FIG. 2A.

FIGS. 2A and 2B show an alternative embodiment of the present invention in which I-beam support sections 4 are used by the support system of the present invention. The I-beam support sections 4 have similar bearing and friction characteristics as those of the H-beam 1, except that the I-beam 4 has a longer mid-section 5 that separates the top and bottom sections 6 of the I-beam 4. Those skilled in the art will understand, in view of the present disclosure, that non-cylindrical support sections other than those shown in FIGS. 1A–2B have similar bearing and friction characteristics and therefore are suitable for use with the present invention. For example, a second mid-section could be added to either of the H-beam or I-beam support sections (i.e., another section that would be parallel to mid-sections 3 or 5, respectively), or the support section could be constructed simply as a cross having to equal length perpendicular sections that intersect each other at their respective mid-points. Those skilled in the art will understand, in view of the description provided herein, the manner in which such alternative non-cylindrical support section designs could be used to achieve the goals of the present invention.

Figure 3:
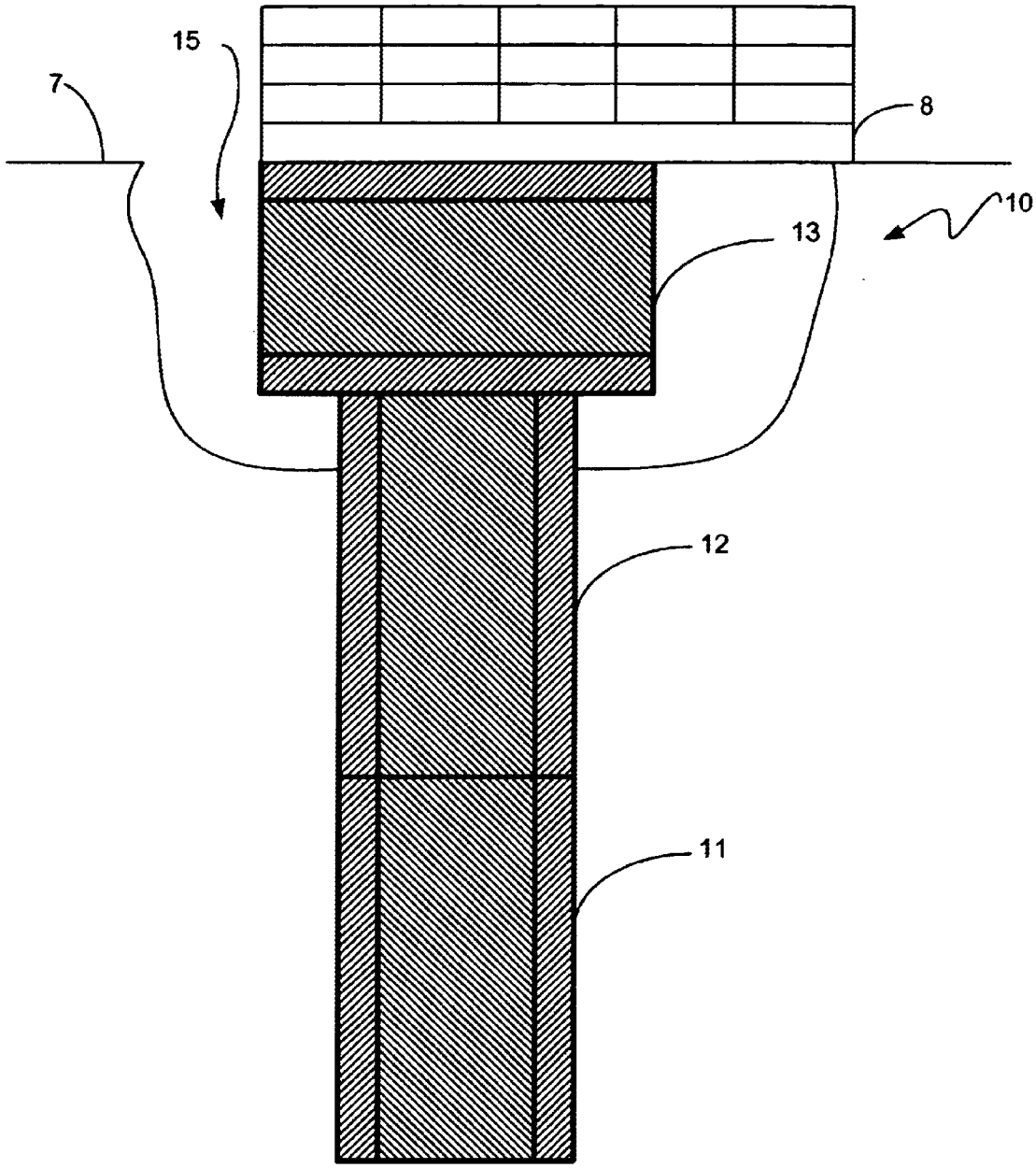
FIG. 3 is an illustration of the support system of the present invention once it has been installed to lift and level the foundation of a building.

FIG. 3 illustrates a side view of the apparatus of the present invention in accordance with one embodiment wherein the apparatus is comprised of a plurality of H-beams that are utilized in accordance with the method of the present invention to lift and level a building. The apparatus 10 is shown installed and supporting a building foundation 8 after being driven into the ground, which is represented by the numeral 7. The method for installing the apparatus 10 of the present invention will be discussed below with reference to FIG. 5.

The apparatus 10 in FIG. 3 is shown as comprising three H-beam sections 11, 12 and 13, although, in reality, many more sections will typically be required to reach a suitable depth in the earth (designated by numeral 7), e.g., until a depth is reached at which a rock strata is encountered. The support section 11 is driven into the ground through a hole 15 that has been formed in the earth (i.e., by digging) underneath the foundation 15. Once the first section 11 has been driven into the ground, the next section 12 is driven into the ground on top of the first section 11. Once a suitable depth has been reached, an H-beam support section 13 is disposed between the upper end of support section 12 and the bottom surface of the foundation 5. A jack (not shown) is then placed on the top surface of support section 13 and the building is jacked up to a suitable height to thereby lift and level the building. Friction between the apparatus 10 (i.e., support sections 11, 12 and 13) and the earth and between the apparatus 10 and the bottom surface of the foundation 5 ensures that the support system will remain stable over time.

Figure 4A:
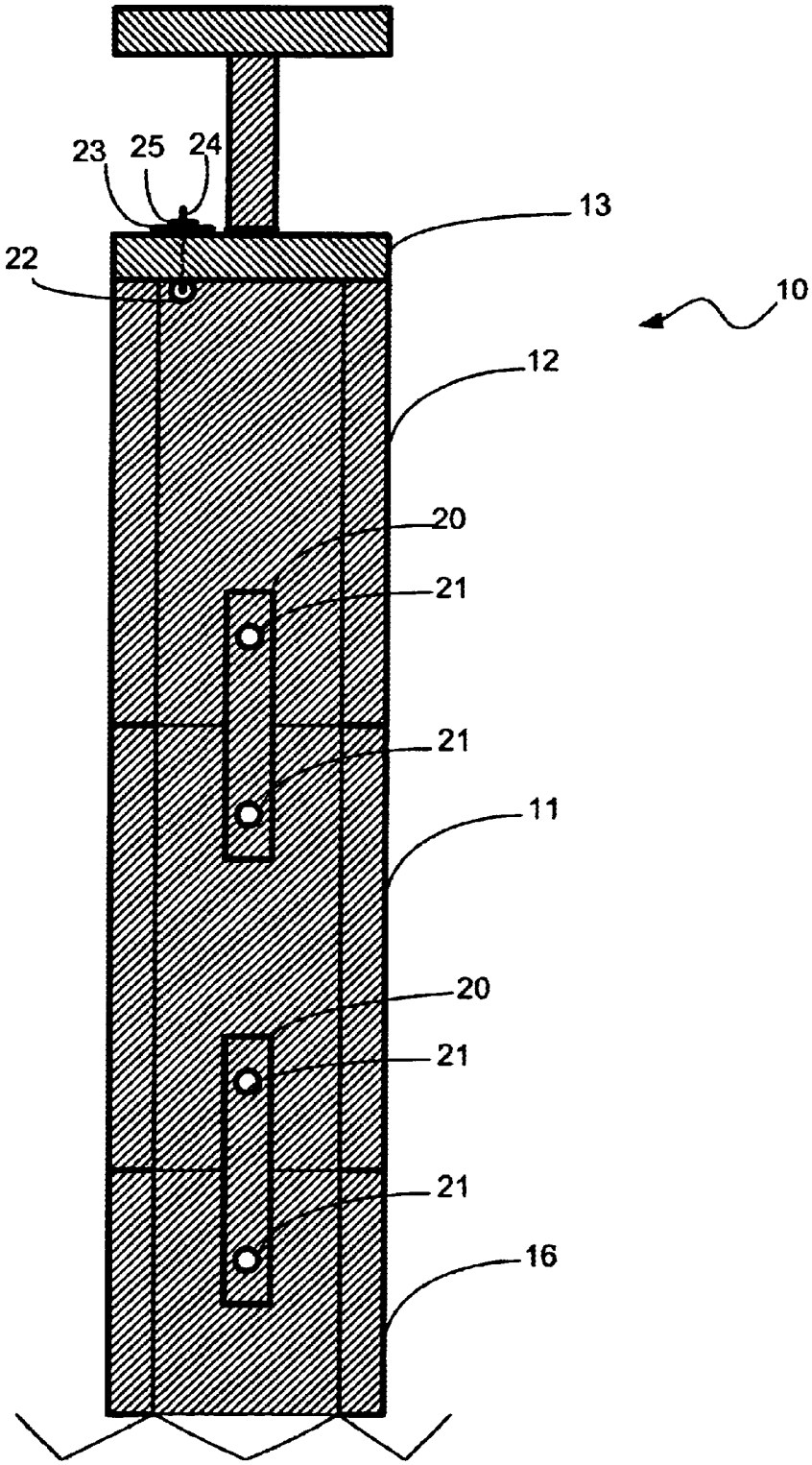
FIG. 4A illustrates a side view of the apparatus of the present invention in accordance with one embodiment for attaching the sections shown in FIGS. 1A and 1B together as they are driven into the ground.
Figure 4B:
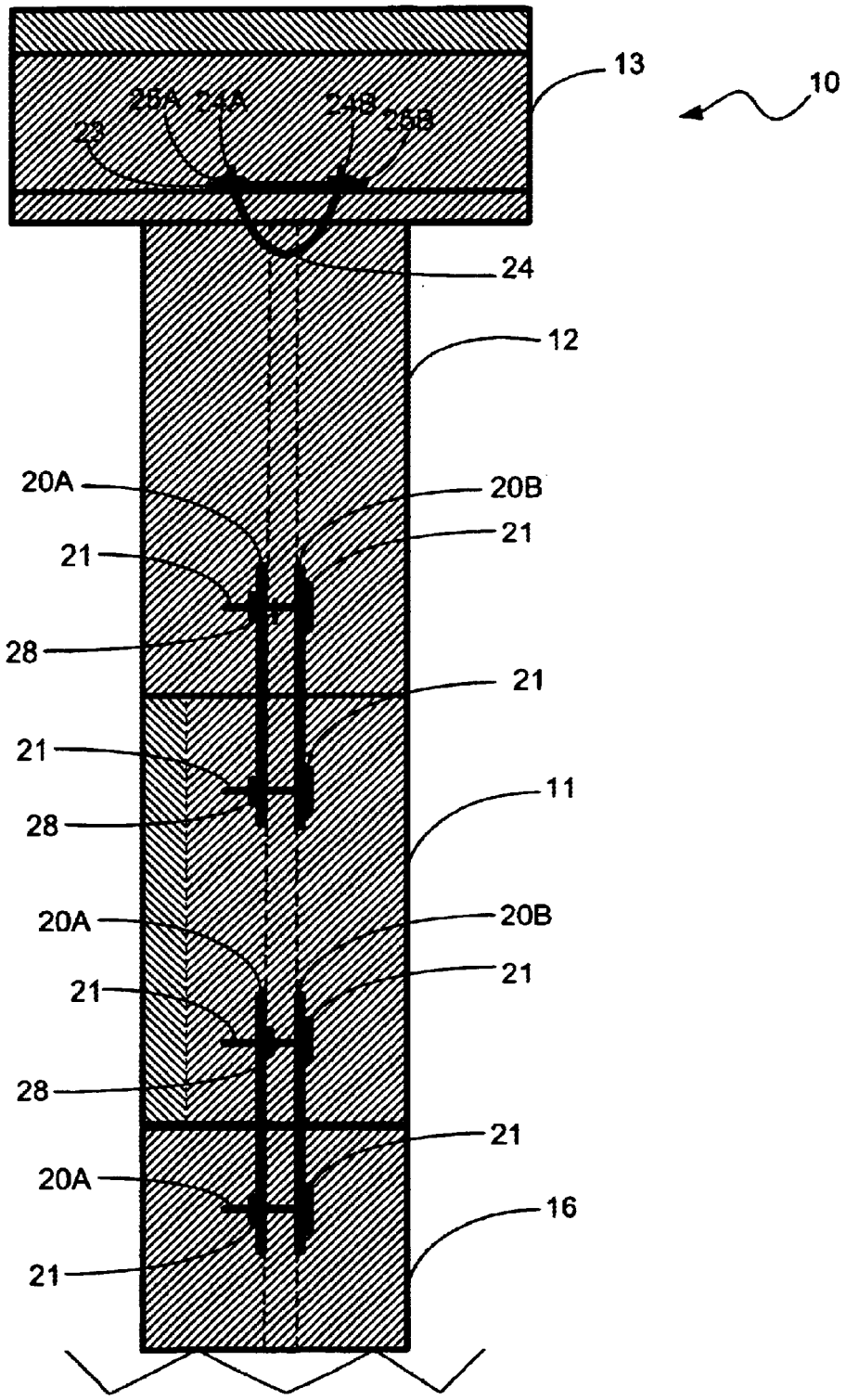
FIG. 4B illustrates a front view of the apparatus shown in FIG. 4A.

In accordance with the embodiment shown in FIG. 3, the H-beams 11, 12 and 13 comprising the apparatus are not fastened together, but are kept in place through their contact with adjacent support sections, through the downward force associated with the weight of the building and though the settling of the soil about the support sections 11 and 12. FIGS. 4A and 4B illustrate side and front views, respectively, of the apparatus 10 shown in FIG. 3 further comprising fastening devices that are utilized to fasten adjacent support sections together, and further comprising a fourth support section 16, which is shown for the purposes of clearly demonstrating the manner in which the support sections can be fastened together in accordance with one embodiment. Although it is not necessary that adjacent support sections be fastened together, fastening adjacent support sections together in the manner shown in FIGS. 4A and 4B enhances stability and further ensures that the apparatus 10, once installed, will not shift, bend, etc. over time.

In accordance with one embodiment, a first type of fastening device is used for fastening the lower support sections (16/11 and 11/12) together and a second type of fastening device is used for fastening the top two support sections (12/13) together. The first type of fastening device is comprised of a plate 20 located on opposing sides of the support sections (only front side shown in FIG. 4A), bolts 21, and nuts (not shown). The bolts 21 pass through openings formed in the plates 20 and the plates 20 on each side of the support section are pulled tightly against the support section by nuts that are fastened to the ends of the bolts 21. With respect to the top two support sections, the second type of fastening device is comprised of a U-bolt (FIG. 4B) that passes through an opening 22 formed in a location in the second-from-the-top upper support section (12) and through two openings (FIG. 4B) formed in the top support section 13. A plate 23 similar in design to plate 20 has openings formed therein through which the ends 24 of the U-bolt pass, which have nuts 25 fastened thereto to pull the two support sections 12 and 13 together.

FIG. 4B is a front view of the apparatus 10 shown in FIG. 4A. The view provided in FIG. 4B illustrates the bolt 21 passing through two plates 20A and 20B, and a nut 28 fastened to the end of the bolt 21 to thereby pull the plates toward each other, which, in turn, fastens ends of adjacent support sections together. The two plates comprised by any given fastening device of the first type are collectively represented by a thick dark line, which is labeled 20A and 20B. It will be understood by those skilled in the art, in view of the present disclosure, that the many fastening device configurations can be used to accomplish the task of coupling the non-cylindrical support sections together. The configuration of the fastening device of the first type is an example of one suitable design for this purpose and is not intended to represent the only suitable design for this purpose. Those skilled in the art will understand, in view of the present disclosure, that this task can be accomplished in virtually an unlimited number of ways.

FIG. 4B also illustrates the configuration of the second type of fastening device, which is used for coupling the top and second-to-the-top support sections 12 and 13, respectively, together. This view shows the U-bolt 24 having ends 24A and 24B that pass through an opening (FIG. 4A, item 22) formed in the mid-portion of support section 12, through two openings (not shown) formed in the top support section 13 and through openings (not shown) formed in a plate 23. The ends 24A and 24B of the U-bolt 24 have nuts 25A and 25B, respectively, fastened thereto, thereby locking support sections 12 and 13 together. As with the first type of fastening device, the fastening device utilized for coupling the non-cylindrical support sections 12 and 13 together is not limited to any particular design. Those skilled in the art will understand, in view of the present disclosure, the manner in which various designs can be used for this purpose, and that these support sections can be coupled together in virtually an unlimited number of ways. Other suitable securing means that can be used in place of the first and/or second fastening device designs, include, but are not limited to, welding, utilizing sleeves, bolts, rivets, etc., in such a way that one solid piling is created that substantially eliminates or reduces the possibility of lateral and/or vertical movement of the piling, even if normal types of lateral and/or vertical movement in the earth about the piling occurs.

Figure 5:
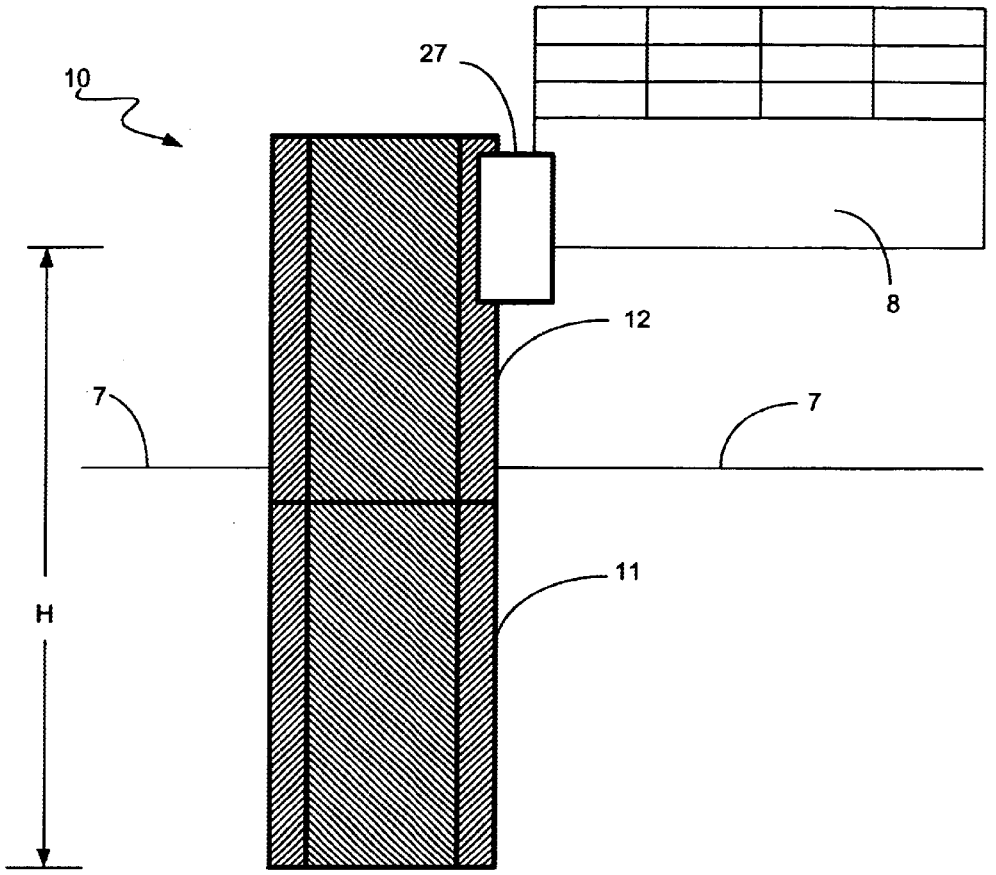
FIG. 5 illustrates the apparatus of the present invention in accordance with one embodiment, wherein the apparatus is bracketed to the foundation of the building at a location adjacent a side of the building.

FIG. 5 illustrates a side view of the apparatus of the present invention in accordance with another embodiment. The apparatus 30 is shown installed and supporting a building foundation 8 from a location adjacent a side of the building. The apparatus 30 is shown as comprising two H-beam sections 11 and 12, although, as stated above, many more sections will typically be required to reach a suitable depth in the earth, e.g., until a depth is reached at which a rock strata is encountered. The support section 11 is driven into the ground at a location adjacent the foundation 8. Once the first section 11 has been driven into the ground, the next section 12 is driven into the ground on top of the first section 11. This process of driving the support sections into the ground creates a piling comprised of the combination of support sections. Once a suitable depth has been reached, a jack (not shown) is utilized to jack up the building to a suitable height, H, above the surface 7 of the ground. The foundation of the building is then bracketed by a bracket 27 to a location on the uppermost support section 12 to maintain the building at the new level. The support sections 11 and 12 are then fastened together using the first types of fastening devices (not shown) discussed above with reference to FIGS. 4A and 4B. These fastening devices ensure that the support s stem will remain stable over time.

The bracket 27 is not limited to any particular design or configuration. Brackets exist that are utilized for lifting and leveling existing buildings and that are suitable for use with the present invention. Those skilled in the art will understand, in view of the present disclosure, that virtually an unlimited number of bracket designs can be used with the present invention for the intended purpose.

Figure 6:
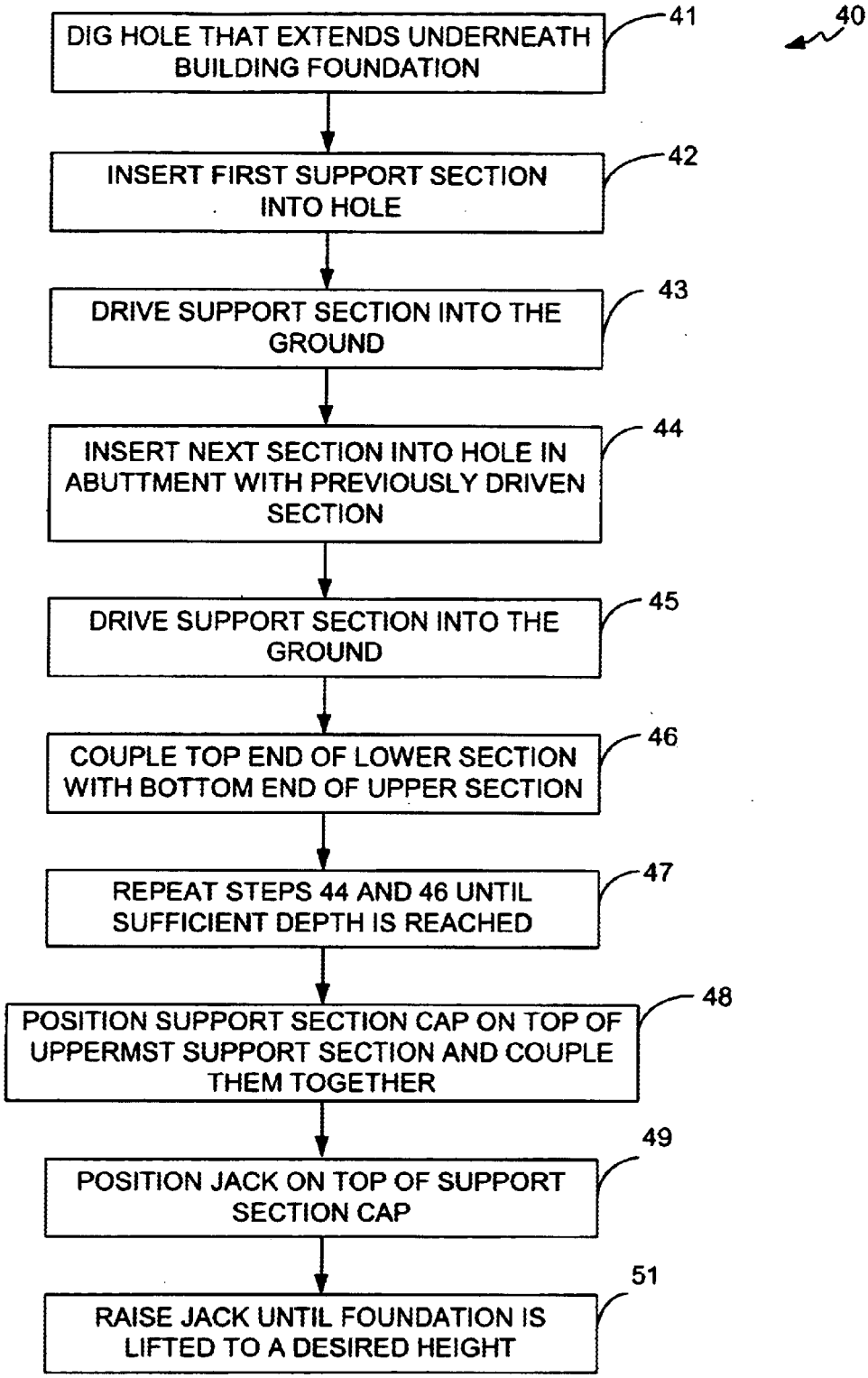
FIG. 6 is a flow chart demonstrating the method of the present invention in accordance with the one embodiment.

FIG. 6 is a flow chart illustrating the method 40 of the present invention in accordance with another embodiment, wherein the apparatus of the present invention illustrated in FIGS. 4A and 4B is utilized to lift and level an existing building. It should be noted that many of the steps shown in FIG. 6 do not need to be performed in the order depicted. Some steps are performed before others, but other steps may be performed in different sequences and/or simultaneously. The first step in the method depicted in the flow chart of FIG. 6 is to dig a hole that begins on the side of the building and extends underneath the building. The hole may be, for example, approximately 2 feet×2 feet wide across the top, about 4 feet deep, and extending approximately 1 foot underneath the building. This step is represented by block 41.

The next step is to press (e.g., by using a hydraulic ram) the non-cylindrical support section into the ground at the bottom of the hole, as indicated by blocks 42 and 43. The bottom end of the next support section is then placed on the top end of the lower support section and is pressed or rammed into the ground, as indicated by blocks 44 and 45. The support sections are then coupled together in the manner described above with reference to FIGS. 4A and 4B, as indicated by block 46. This process of driving the support sections into the ground and coupling them together is repeated until the non-cylindrical support sections cannot be further pressed into the ground (which typically occurs when the lower-most support section is at a depth of between 10 and 80 feet, but possibly more) and/or stable soil or rock has been reached, or simply until a desired depth has been reached, as indicated by block 47. The cap support section (support section 13 in FIGS. 3–4B) is then placed on top of the uppermost support section (support section 12 in FIGS. 3–4B), as indicated by block 48. A jack, preferably a hydraulic jack, is then disposed between the cap support section and the foundation of the building and the building is lifted and leveled using the jack, as indicated by blocks 49 and 51.

Once the foundation is lifted and stabilized, another support section having a suitable length will be placed next to the jack on top of the cap support section and shimmed tight, preferably with steel shims. The jack can then be lowered and removed. Once these steps have been performed, the hole that was dug will be covered with dirt so that none of the piling is showing. These steps will be performed at each location(s) that needs lifting, leveling and stabilization. The length of the piling may be adjusted if further lifting/leveling is ever needed. This can be accomplished by digging down to the cap support section and following the steps discussed above (i.e., placing the jack at the proper position, re-raising the area at issue and inserting the shim).

Figure 7:
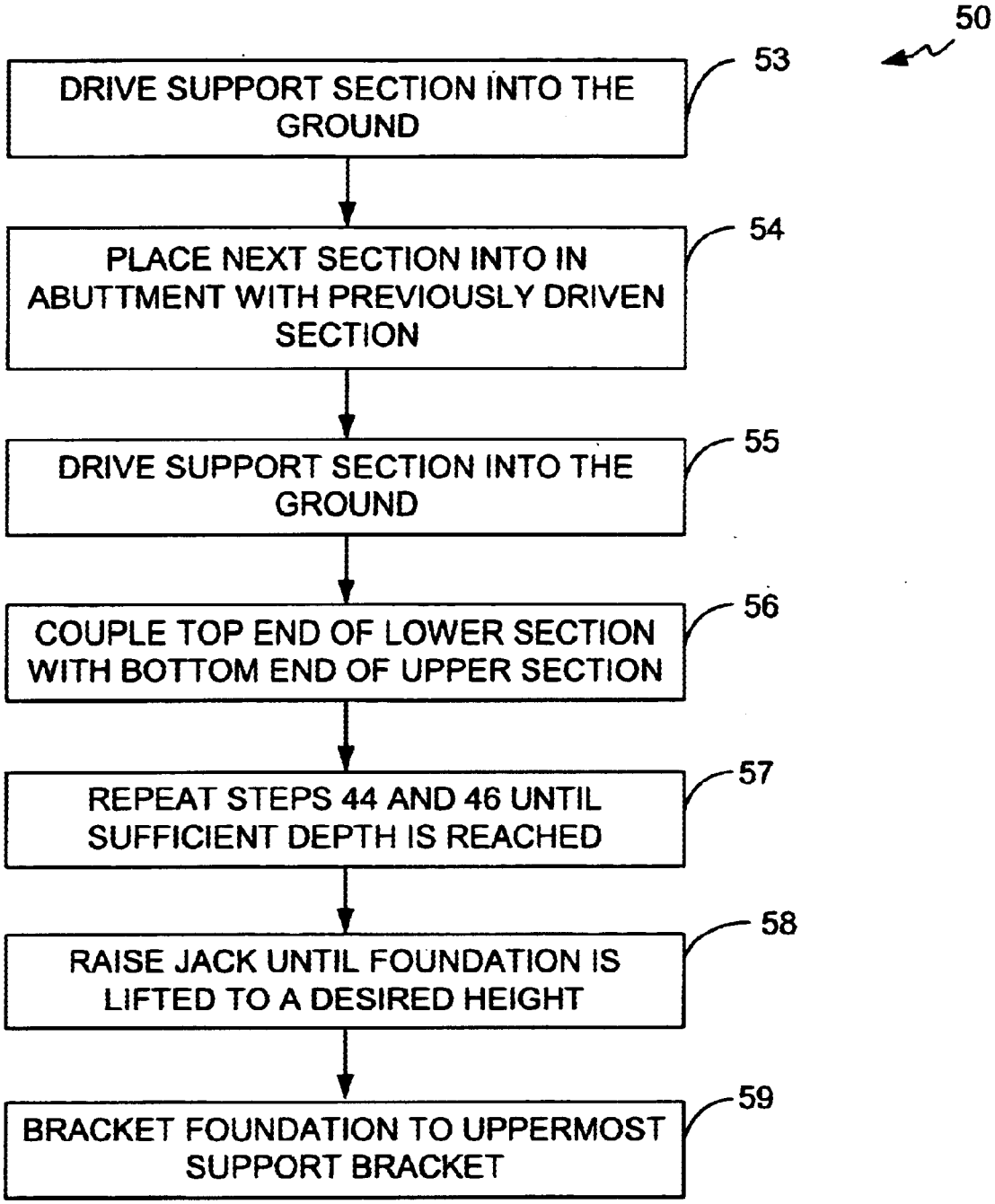
FIG. 7 is a flow chart demonstrating the method of the present invention in accordance with a second embodiment.

FIG. 7 is a flow chart illustrating the method 50 of the present invention in accordance with another embodiment, wherein the apparatus of the present invention illustrated in FIG. 5 is utilized to lift and level an existing building and is installed adjacent a side of the building. It should be noted that many of the steps shown in FIG. 7 do not need to be performed in the order depicted. Some steps are performed before others, but other steps may be performed in different sequences and/or simultaneously. The first step in the method depicted in the flow chart of FIG. 7 is to drive (e.g., by using a hydraulic ram) the non-cylindrical support section into the ground at a location adjacent the building, as indicated by block 53. The bottom end of the next support section is then placed on the top end of the lower support section and is driven or rammed into the ground, as indicated by blocks 54 and 55. The support sections are then coupled together in the manner described above with reference to FIGS. 4A and 4B, as indicated by block 56. This process of driving the support sections into the ground and coupling them together is repeated until the non-cylindrical support sections cannot be further pressed into the ground (which typically occurs when the lower-most support section is at a depth of between 10 and 80 feet, but possibly more) and/or stable soil or rock has been reached, or simply until a desired depth has been reached, as indicated by block 57. A jack, preferably a hydraulic jack, is then used to raise the building to the desired height, as indicated by blocks 58. The foundation is then bracketed to the uppermost support section, as indicated by block 59. Once the foundation is lifted and stabilized, the jack can then be lowered and removed.

Figure 8:
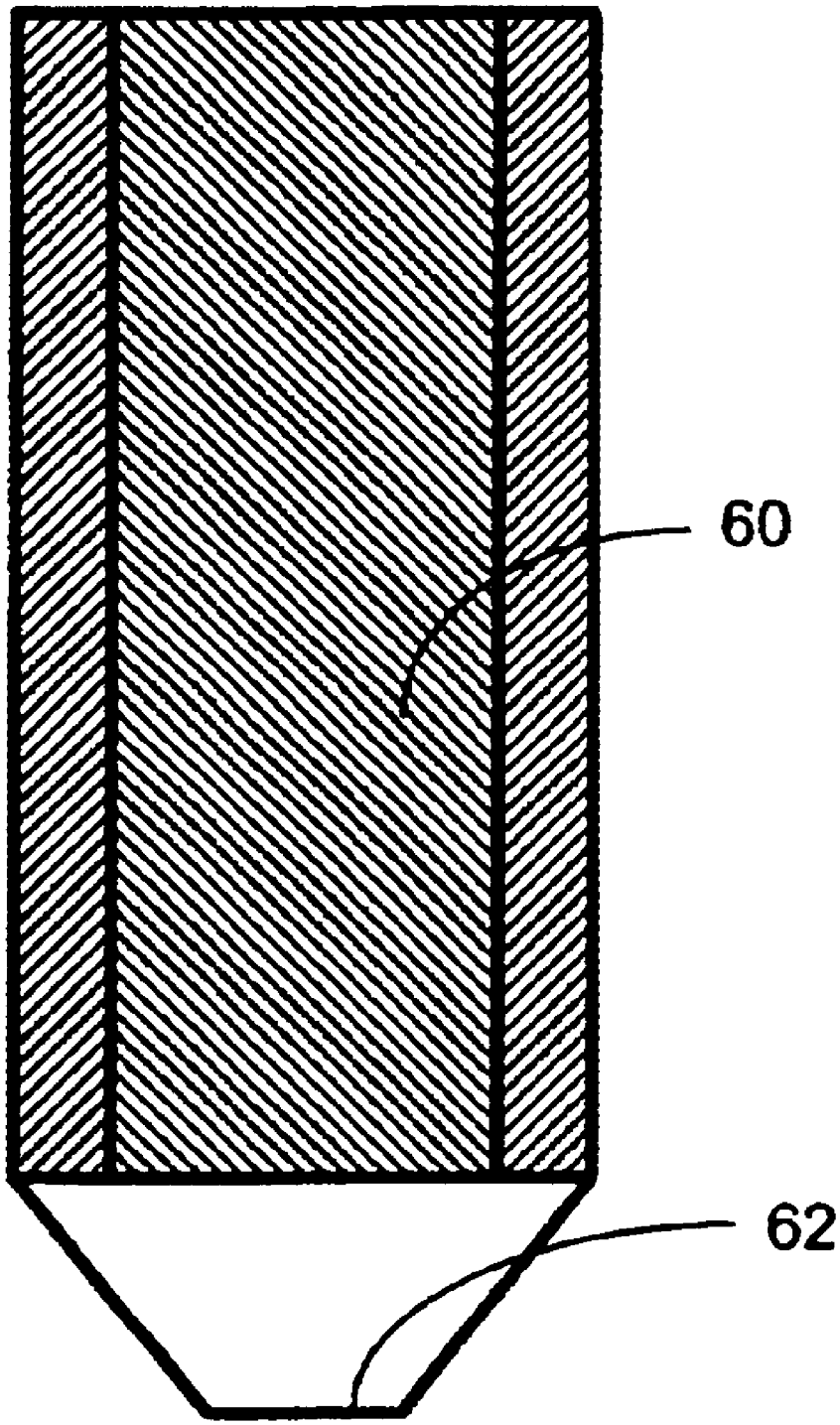
FIG. 8 is a plan view of the apparatus shown in FIG. 1B wherein the end of the apparatus is sharpened, or tapered, to further reduce bearing when the apparatus is driven into the earth in accordance with the method of the present invention.

In accordance with another embodiment of the present invention, the first support section driven into the ground has a tapered end. For example, if the apparatus of the present invention comprised a non-cylindrical support section having the shape shown in FIGS. 1A and 1B, the lowermost support section could have the shape shown in FIG. 8, which is a front view of an H-beam 60 having a tapered lower end 62. This tapered, or sharpened, lower end would result in even less bearing encountered when the piling is being installed. However, the piling would still have essentially the same desirable friction characteristics as if it were formed of support sections such as those shown in FIGS. 1A–2B.

Figure 9:
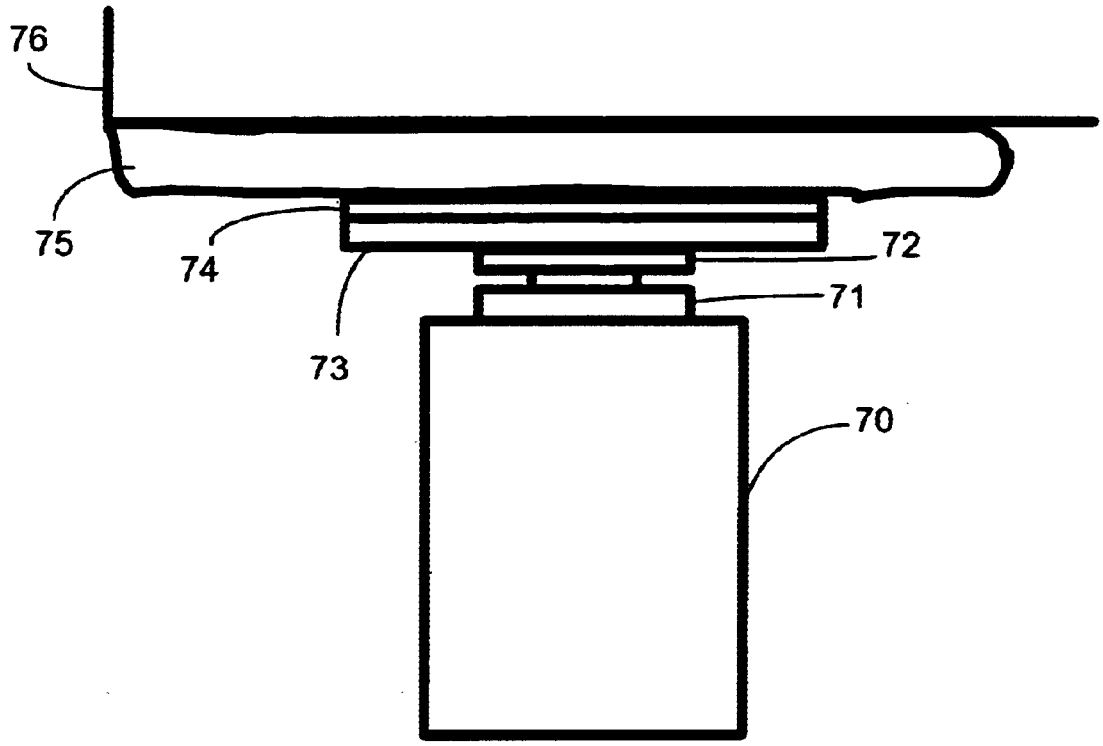
FIG. 9 is a plan view of a hydraulic ram having a plate attached to an uppermost portion of the ram that is designed to conform to the contour of the building foundation and to prevent the force of the ram from shattering the foundation.

In accordance with another embodiment of the present invention, which will be discussed with reference to FIGS. 4A–5 and 9. FIG. 9 illustrates a jack 70 having a flexible top surface 80 secured thereto.

It should be noted that while the present invention has been described with reference to the particular embodiments, it is not limited to the particular embodiments described herein. Those skilled in the art will understand, in view of the present disclosure, that modifications can be made to the embodiments described herein and that such modifications are within the scope of the present invention.

What is claimed is:

1. An apparatus for lifting and leveling an existing building from a position underneath the existing building, the apparatus comprising:

at least a first non-cylindrical support section, the first non-cylindrical support section having a substantially rectangular shape, the first non-cylindrical support section having a first end and a second end;

a cap support section having a first side and a second side and a solid interior, the first side of the cap support section being in contact with the second end of the first non-cylindrical support section, whereby the second side of the cap support section is operable to be placed in contact with a foundation of the existing building;

a first fastening device coupling the first non-cylindrical support section to the cap support section;

a second non-cylindrical support section, the second non-cylindrical support section having a substantially rectangular shape, the second non-cylindrical support section having a first end and a second end, wherein, the first end of the second non-cylindrical support section is located within the earth beneath said first non-cylindrical support section such that the first end of said first non-cylindrical support section is in contact with the second end of said second non-cylindrical support section; and a second fastening device coupling the first non-cylindrical support section to the second non-cylindrical support section.

2. The apparatus of claim 1, wherein said first non-cylindrical support section is an H-beam.

3. The apparatus of claim 1, wherein said first non-cylindrical support section is an I-beam.

4. The apparatus of claim 1, wherein said first and second non-cylindrical support sections are H-beams.

5. The apparatus of claim 1, wherein said first and second non-cylindrical support sections are I-beams.

6. The apparatus of claim 1, wherein said first end of said second non-cylindrical support section is tapered.

7. An apparatus for lifting and leveling an existing building from a position adjacent to the existing building, the apparatus comprising:

a first non-cylindrical support section, the first non-cylindrical support section having a substantially rectangular shape, the first support section having a first end and a second end;

a bracket configured to secure to a foundation of the building and to said first non-cylindrical support section, the bracket having a solid interior;

a bottom non-cylindrical support section having a substantially rectangular shape, said bottom non-cylindrical support section operable to be placed in the earth below said first non-cylindrical support section, said bottom non-cylindrical support section having a first end and a second end, said first end being tapered.

8. The apparatus of claim 7, wherein said first and bottom non-cylindrical support sections are H-beams.

9. The apparatus of claim 7, wherein said first and bottom non-cylindrical support sections are I-beams.

10. The apparatus of claim 7, further comprising:

a substantially rectangular shaped middle non-cylindrical support section, said middle non-cylindrical support section having a first end and a second end;

wherein, said middle non-cylindrical support section is located within the earth between said first non-cylindrical support section and said bottom non-cylindrical support section; and wherein said second end of said middle non-cylindrical support section is in contact with the first end of said first non-cylindrical support section.

11. The apparatus of claim 10, further comprising a fastening device coupling the first non-cylindrical support section to the middle non-cylindrical support section.

* * * * *